United States Patent [19]

Dunbar et al.

[11] 4,263,239

[45] Apr. 21, 1981

[54] DRY FORMING OF FIBROUS MATERIAL

[75] Inventors: John H. Dunbar, Marlborough; Kenneth L. Gray, Kenilworth, both of England

[73] Assignee: Courtaulds Limited, London, England

[21] Appl. No.: 943,131

[22] Filed: Sep. 18, 1978

[51] Int. Cl.[3] ..... D04H 1/20

[52] U.S. Cl. ..... 264/518; 264/112; 264/118; 264/120

[58] Field of Search ..... 264/518, 112, 118, 120

[56] References Cited

U.S. PATENT DOCUMENTS

| | | | |
|---|---|---|---|
| 3,050,427 | 8/1962 | Slayter et al. | 264/518 |
| 3,054,714 | 9/1962 | Johnston | 264/518 |

OTHER PUBLICATIONS

S. A. Rydholm, "Pulping Processes", 1965, p. 760.

Aldred, F. C., Processing of Pulp, Provisional Specification, No. 35428/77, 24 Aug., 1977.

*Primary Examiner*—Donald E. Czaja
*Assistant Examiner*—James R. Hall
*Attorney, Agent, or Firm*—Davis, Hoxie, Faithfull & Hapgood

[57] ABSTRACT

A process for producing a consolidated sheet of substantially dry fibrous material, for example wood pulp, comprising supplying fibrous material, having a moisture content of not more than 30 percent by weight on the total weight of the fibrous material, to a hopper and onto a gas-pervious conveyor while drawing gas through the conveyor (and through the fibrous material thereon), carrying the dry fibrous material on the conveyor surface from the hopper beneath means for reducing upward protrusions therefrom to form a layer of the fibrous material and applying pressure to said layer to consolidate the fibrous material to form a coherent sheet.

10 Claims, 3 Drawing Figures

DRY FORMING OF FIBROUS MATERIAL

This invention relates to the deposition of substantially dry fibrous material as a layer and the subsequent compression of the layer of fibrous material to form a consolidated sheet of the material. The fibrous material can be dry wood pulp, for example from a flash dryer. The invention is particularly concerned with the problem of preparing fibrous material, such as wood pulp, in a compact form suitable for transportation, using a simple procedure and small-scale apparatus involving comparatively low capital cost.

The sheet of dry wood pulp can be reeled, or chopped and the pieces stacked in a bale.

Dry wood pulp for use in the present invention can be prepared as a suspension of wood pulp fibers in air and advantageously has a moisture content no higher than from 8 to 12 percent by weight. Such suspensions are produced by flash drying wood pulp. The wood pulp is then advantageously separated from the large volume of air in a cyclone before deposition to form a layer in the process according to the present invention.

According to the invention, substantially dry fibrous material is formed into a sheet by:

(1) supplying fibrous material, having a moisture content of not more than 30 percent by weight on the total weight of the fibrous material, to a hopper located above a gas-pervious continuous conveyor belt, (2) drawing gas through said belt (and through the fibrous material on said belt), (3) carrying the dry fibrous material on said belt away from said hopper as a layer through an exit between a lower edge of a front wall of said hopper and said belt, (4) maintaining the average rate of delivery of dry fibrous material into the hopper and its removal by said conveyor belt such that the level of material in said hopper remains above said exit, and (5) applying pressure to said layer to consolidate the fibrous material to form a coherent sheet.

The fibrous material may be supplied to said conveyor belt from a cyclone from which the material is conveyed by ducting means.

In order to ensure that the layer of fibrous material carried to said pressure-applying means on the conveyor belt has a substantially uniform thickness, a horizontal roller may be arranged above the conveyor belt with its axis extending laterally of the belt. The roller may have outwardly projecting blades and may be rotated relatively rapidly in relation to the speed of movement of the conveyor belt.

The apparatus and process according to the invention can for example produce a layer of wood pulp having a weight per unit area basis weight of 150 to 3000 g/m$^2$ at speeds of up to 100 m/min.

Figure 1:
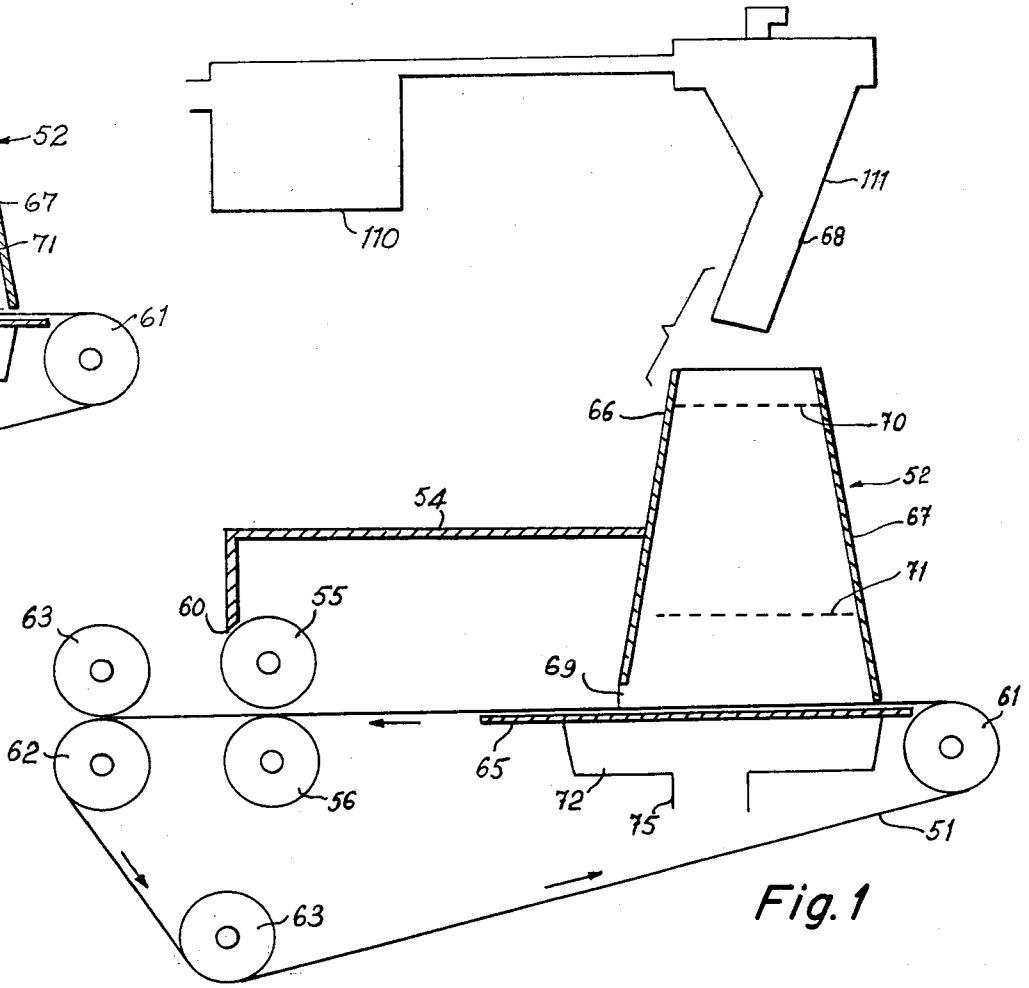
Figure 1A:
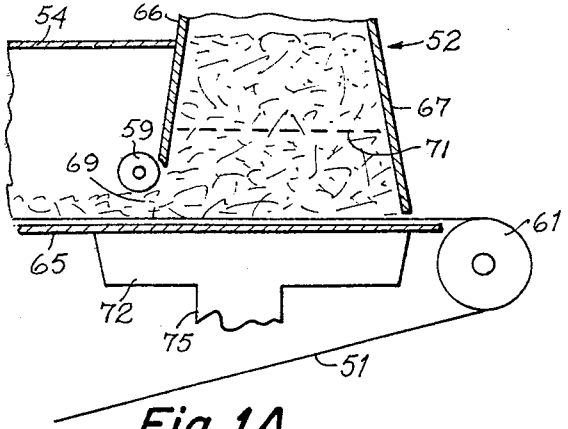
Figure 2:
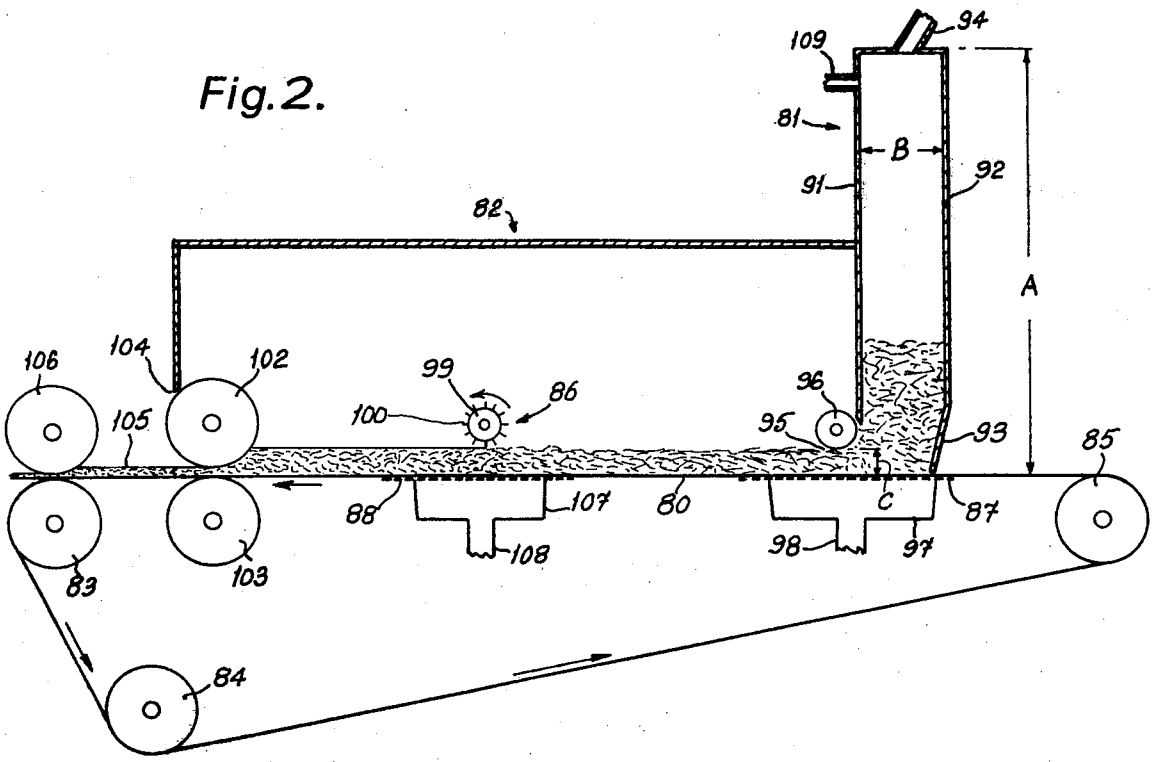
Figure 3:
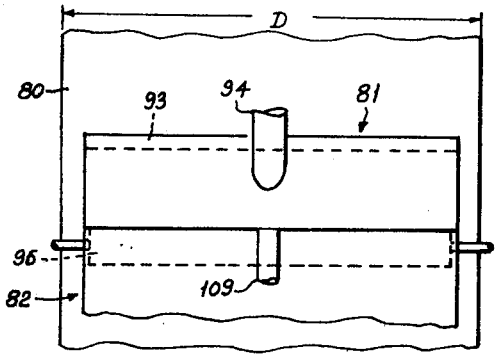

The invention will be further described, by way of example, with reference to the accompanying drawings, in which:

FIG. 1 is a diagrammatic sectional side elevation of apparatus for performing one embodiment of the process of the invention, FIG. 1A is a diagrammatic sectional side elevation of part of a modified form of the apparatus of FIG. 1, FIG. 2 is a diagrammatic sectional elevation of a part of apparatus for performing a second embodiment of the process of the invention, and FIG. 3 is a plan of the part of the apparatus of FIG. 2.

The apparatus shown in FIG. 1 comprises generally a flash dryer 110, a cyclone 111, a gas-pervious conveyor belt 51, a hopper 52 and a housing 54.

Fibrous wood pulp is dried in a large volume of air to a moisture content of no more than 30 percent by weight on the total weight of the pulp in flash dryer 110. Cyclone 111 separates the fibrous wood pulp from the air, the pulp dropping into duct 68 positioned below cyclone 111.

The conveyor belt 51 is a gas-pervious mesh conveyor of metallic wire or plastic material, for example nylon or polyester monofilament. It moves in a counterclockwise direction, as shown, around rollers 61, 62 and 63. Below the hopper 52 the conveyor belt 51 moves over a stationary gas-pervious plate 65.

The hopper 52 is of generally rectangular cross-section having a front wall 66 and a back wall 67, and it broadens towards the conveyor belt 51 which acts as the base of the hopper. The hopper 52 is positioned to receive dry fibrous material in the form of dry wood pulp via a duct 68 leading from cyclone 111 which in turn leads from flash dryer 110. The exit 69 of the hopper 52 is defined by conveyor belt 51 and the bottom edge of the front wall 66 of the hopper. The height of the exit 69 determines the height of the layer of pulp on the conveyor belt 51. The bottom edge of the front wall 66 serves to reduce upward protrusions from the upper surface of the dry wood pulp on the conveyer belt 51, thus producing a layer of substantially uniform thickness.

As shown, the bottom of front wall 66 is a simple edge; alternatively, as shown in FIG. 1A, a roller 59 can be mounted to rotate freely at the bottom of front wall 66. This helps to prevent pulp from sticking in the hopper 52 near the exit 69, particularly when running at high speeds. Movement of the pulp on conveyor belt 51 causes the roller 59 to rotate clockwise in the configuration of FIG. 1A. The roller 59 rotates so that its uppermost part carries pulp downwards and away from the front wall 66 of the hopper rather than allowing it to escape around the uppermost part of the roller 59 and also reducing upward protrusions on the layer of pulp.

The rear wall 67 (or one of the side walls, not shown) of the hopper can be formed with a window (not shown) so that the level of wood pulp in the hopper 52 can be observed. Alternatively, the hopper can be fitted with a detecting device to determine that the level of the pulp in the hopper 52 stays between desired upper and lower limits 70 and 71.

A suction box 72 is positioned below the gas-pervious conveyor belt 51 and hopper 52. Suction box 72 extends across the width of the hopper and lengthwise from the rear wall 67 of the hopper to beyond the front wall 66. A duct 75 opening into suction box 72 communicates with a fan (not shown) arranged to draw gas from the hopper 52 through the pulp in the hopper and through the gas-pervious conveyor belt 51 into the suction box 72.

The application of suction through the gas-pervious conveyor belt 51 to the wood pulp in the hopper 52 serves to prevent undesirable sticking or bridging of wood pulp in the hopper and thus to give a consistent feed of even thickness through the exit 69. The degree of suction applied can be varied, for example between 1 cm water gauge and 60 cm water gauge. Increased suction holds the wood pulp fibers more tightly against the conveyor belt 51 forming a more dense mass of fibers on the conveyor. Increased suction thus increases the bulk density of the layer of fibers carried through exit 69 and hence the weight per unit area (basis weight) of the layer of wood pulp on feed conveyor belt 51. Typically the bulk density of the pulp carried through the exit 69 may be in the region of 0.04 g/cc.

Variations in suction between 1 cm water gauge and 10 cm water gauge can change the basis weight of the layer of wood pulp by a factor of 2. The height of the exit 69 can be adjusted if pulp sheets of greatly differing basis weights are desired but smaller differences in basis weights can be achieved by using various suction pressures applied by the suction box 72.

Suction can be applied evenly or unevenly across the width of the gas-pervious conveyor belt 51 and the hopper 52 by varying the size and distribution of the apertures in the gas-pervious plate 65 underneath the hopper. It may be desirable to apply greater suction at the sides of the hopper 52 than at the middle and this can be achieved, for example, if the plate 65 has more or larger apertures at the sides. When suction is applied evenly there is a tendency for the exit of pulp from the hopper to be easier at the center of the conveyor. By applying more suction at the sides of the hopper than in the middle this tendency can be overcome.

In the apparatus shown in FIG. 1, the conveyor belt 51 carries the layer of pulp from the exit 69 of hopper 52 within the housing 54 to consolidation rollers 55, 56 which compress the pulp with a force in the region of 4.5 kg/linear cm, to a bulk density which may typically be from 0.05 to 0.10 g/cc. The roller 55 is sealed against the housing 54 at 60. The consolidation rollers compress the pulp so that fibers are not blown off the pulp surface but the pulp layer is still supported by the conveyor belt 51 as it passes through the nip between a pressure roller 64 and the roller 62 which compresses the pulp layer further using a force in the region of 90 kg/linear cm into a coherent sheet with a bulk density which may be from 0.10 to 0.50 g/cc, which sheet is the final product. The conveyor belt 51 separates from the pulp sheet at the roller 62. The pulp sheet can pass to calender rolls (not shown) where its bulk density and coherence are still further increased by application of a force which may be in the region of 900 kg/linear cm to a bulk density which may be from 0.7 g/cc to 1.2 g/cc.

So long as sufficient pulp is held in the hopper 52 the basis weight of the pulp sheet produced is dependent primarily upon the height of the exit 69 and the pressure applied through the suction box 72. The basis weight is generally independent of the speed of the conveyor belt 51, and this speed can be varied to maintain the level of pulp in the hopper 52 within prescribed limits. The apparatus of FIG. 1 can thus form a continuous pulp sheet of substantially consistent basis weight from a somewhat irregular supply of pulp, such as the feed from a continuously operated flash dryer 110 and cyclone 111. The apparatus can for example produce a layer of pulp having a basis weight of from 300 to 2000 g/m$^2$ at speeds of up to 100 m/min.

Textile fibers and dry wood pulp can be formed into a layer together, for example polypropylene fibers can be mixed with wood pulp by metering them into the hopper 52.

The apparatus shown in FIGS. 2 and 3 comprises gas-pervious conveyor belt 80, a hopper 81 and a housing 82.

The conveyor belt 80 comprises a mesh of metallic wire or plastic material, for example nylon or polyester monofilaments. The belt moves in a counterclockwise direction, as shown around rollers 83, 84 and 85. When passing below the hopper 81 and below a trimming device 86, further described below, the conveyor belt 80 moves over stationary gas-pervious plates 87 and 88, respectively.

The hopper 81 is of generally rectangular cross-section, having a front wall 91 and a rear wall 92, which are parallel to one another, as well as parallel side walls (not shown). All the walls are vertically oriented in the apparatus of FIGS. 2 and 3. A portion 93 of the rear wall adjacent the conveyor belt 80 is inclined downwardly and forwardly with respect to the main upper part of the rear wall 92. The conveyor belt 80 acts as the base of the hopper which receives dry fibrous material, such as dry wood pulp, via a duct 94, for example from a cyclone such as cyclone 111 of FIG. 1.

The exit 95 of the hopper 81 is defined by the conveyor belt 80 and a roller 96 mounted to rotate freely at the bottom of the front wall 91 and extending parallel to that wall and horizontally across and above the belt 80. The function of the roller 59, 96 is the same as that of the roller described in the apparatus of FIG. 1A.

The hopper 81 may have a window (not shown) or a detecting device (not shown) to monitor the level of pulp in the hopper in the same way as described in relation to the hopper of FIG. 1.

A suction box 97 is positioned below the gas-pervious conveyor belt 80 and hopper 81. The suction box 97 extends across the width of the hopper and lengthwise of the conveyor belt 80 from where the forwardly inclined position 93 of the rear wall of the hopper approaches most closely to the conveyor belt 80 to a location forward of the roller 96 in relation to the direction of movement of the upper reach of the conveyor belt 80. A duct 98 opening into the suction box 97 communicates with a fan (not shown) arranged to draw gas from the hopper 81 through the pulp in the hopper and through the gas-pervious conveyor belt 80 into the suction box 97.

The results achieved by the suction applied to the suction box 97 are similar to those achieved by the suction applied to the suction box 72 in the apparatus of FIG. 1 and the degree of suction applied can be similar to that used in the apparatus of FIG. 1. The degree of suction can be caused to vary across the conveyor belt 80, also as described with regard to the apparatus of FIG. 1.

The bulk density of the layer of pulp carried forward from the hopper 81 to the trimming device 86 by the conveyor belt 80 is typically in the region of 0.02 g/cc.

The trimming device 86 comprises a roller 99 horizontally disposed above the conveyor belt 80 to extend across and parallel thereto. The roller has radially extending blades 100 and, in use, is rotated counterclockwise as seen in FIG. 2 so as to throw rearwardly (that is, in the direction opposite to the direction of movement of the upper reach of the conveyor belt 80) any pulp projecting above the level of the lowest limit of movement of the tips of the blades 100. The trimming device thus serves to even out further the layer of pulp on the conveyor belt 80 to prepare the pulp as a layer of substantially uniform thickness for passage to consolidation rollers 102 and 103 mounted one above and one below the conveyor belt 80 which compress the pulp, as do the rollers 55 and 56 in the apparatus of FIG. 1, with a force in the region of 4.5 kg/linear cm to a bulk density which may, typically, be from 0.05 to 0.10 g/cc. The roller 102 is sealed against the housing 82 at 104.

The rollers 102 and 103 (which are driven by means, not shown) compress the pulp so that fibers are not blown off the surface of the pulp layer but the layer 105 needs the support of the conveyor belt 80 as it is forwarded by the conveyor belt 80 to the nip between a driven pressure roller 106 and the driven roller 83. In this nip the pulp layer is subjected to a force in the region of 90 kg/linear cm, and is consolidated so that it constitutes a coherent sheet with a bulk density which may be from 0.10 to 0.50 g/cc. The pulp sheet can be forwarded from the rollers 106 and 83 to calender rolls (not shown) to subject it to force which may be in the region of 900 kg/linear cm and compress it to a bulk density which may be from 0.7 to 1.2 g/cc.

In order to avoid serious disturbance of the pulp layer by the trimming device 86, a suction box 107 is located beneath the conveyor belt 80 at the position of the trimming device and extends forwardly and rearwardly of the device beneath the plate 88. A duct 108 leads from the suction box 107 to a fan, not shown, which draws air from within the housing 82 through the pulp layer in the region of the trimming device and into the suction box 107. This flow of air maintains the pulp in close contact with the conveyor belt 80 in the region of the trimming device 86 and resists any tendency of the trimming device to disturb the bulk of the pulp layer.

Air drawn into the ducts 98 and 108 may be recycled back to the hopper 81 through a duct 109 by suitable means (not shown). In addition, some air may be recycled from the ducts 98 and 108, or one of them by suitable means (not shown), direct into the housing 82 in order to assist the flow of air into the suction box 107.

The relationship of the basis weight of the pulp sheet produced in the apparatus of FIGS. 2 and 3, the height of the hopper exit 95 and the degree of suction applied through suction box 97 is similar to the relationship between the corresponding factors in the apparatus of FIG. 1, and the apparatus of FIGS. 2 and 3 can be used to produce coherent sheets from layers of mixed fibers as can the apparatus of FIG. 1.

The height A (FIG. 2) of the hopper 81 in the embodiment of FIG. 2 is chosen in dependence upon the degree of variation in the rate of supply of pulp to the hopper along the duct 94. The greater the variation expected, the greater is the height required to allow for the variation in the position of the surface of the pulp stored in the hopper.

The length (that is the front-to-back dimension B) of the hopper 81 and the height C of the exit 95 of the hopper are chosen in dependence upon the type of dry fibrous material fed to the hopper and upon the basis weight of the sheet which is to be produced. The plan view, FIG. 3, of a portion of the apparatus of FIG. 2 shows the relative widths of hopper 81, conveyor belt 80 and housing 82 of the embodiment. The width of the hopper 81 determines the width of the pulp layer and, thus, of the coherent sheet produced. As can be seen in FIG. 3, the side walls of the housing 82, which come down close to the upper surface of the conveyor belt 80 are spaced internally to corespond to the width D of the conveyor belt so that the pulp layer leaving the hopper 81 moves on the belt 80 as a close fit between the side walls of the housing.

In the apparatus shown in FIGS. 2 and 3, the diameter of the roller 96 is approximately 30 mm and the forward inclination of the lower portion 93 of the rear wall of the hopper 81 is such that the height of the portion 93 is between 150 and 200 mm and the hopper 81 is approximately 25 mm narrower at its base than at the level of the upper edge of the portion 93. That is, the distance between the projection on the conveyor belt 80 of the front wall 91 and the lower edge of the portion 93 is 25 mm less than the length B of the hopper.

In one exammple of normal operation using wood pulp with a fiber length of from 0.9 to 1.0 mm with a moisture content of from 8 to 12 percent by weight on the total weight of the pulp and a density of from 0.02 to 0.10 g/cc, B is arranged to be equal to 15 cm and C to 4.5 cm. The pulp falls into the hopper from duct 94 as loose clumps condensed from individual fibers. A preferred density of pulp which falls under gravity from the cyclone thru duct 94 is 0.02 g/cc, and the density of the pulp in the bottom of the hopper 81 rises to 0.03 g/cc. The pulp piles up in the hopper 81 and incoming pulp tumbles over the pulp pile until it finds its position in the "head" of pulp which flows down the hopper as a body. Suction of 10 cm water gauge is applied at the suction box 97 and a basis weight in the region of 2000 $g/m^2$ is achieved at the base of the hopper. Because the hopper 81 has a short length B, the conveyor belt 80 propels only a relatively small quantity of pulp forward towards the exit 95. In addition the forward inclination of the portion 93 of the rear wall of the hopper 81 may assist in achieving a smooth flow of the pulp down the hopper and then forward beneath the roller 96.

If a pulp layer of greater basis weight is achieved by increasing the height C of the exit 95, as described above, it may be desirable to increase also the length B of the hopper. Similarly, if C is reduced, it may be desirable to reduce B, a ratio of C:B of from 1:2 to 1:4 and preferably in the region of 1:3 being desirable to achieve good flow of pulp through the hopper and a smooth translation of the initial downward movement on the conveyor belt 80. The apparatus of FIG. 1, shown with a hopper 52 of much greater length than that of hopper 81 of FIG. 2, may nevertheless be chosen for processing some types of dry fibrous material at a suitable level of suction applies to the box 72.

The apparatus of FIG. 1 and the apparatus of FIGS. 2 and 3 can be adapted to permit passage of a gas or gases through the layer of pulp on the conveyor belt 51 or 80 by means of a housing (not shown) above the belt and a sucton box (not shown) below it. Such an arrangement can be used to pass through the fibrous material a gas which will cool it or react chemically with it.

The roller 96 in the apparatus of FIG. 2 and the corresponding roller 59 in the apparatus of FIG. 1A may be driven at a speed such that the part of the roller closest to the conveyor belt moves in the same direction as the belt at a higher speed. This assists in producing an even layer of fibrous material, and the roller may have the effect of tending to fill up depressions in the upper surface of the pulp as well as removing upward protrusions.

Advantageousy, if the fibrous material has to be dried before supplying it to the apparatus of FIG. 1 or FIGS. 2 and 3, for example as in the case with wood pulp, it is dried in a machine such as that described in British Patent Specification No. 888,845 which divides the material finely and possibly into individual fibers.

The use of a cyclone 111 to separate the dried fibrous material from the gas used to dry it, as in flash dryer 110 and to convey it results in a material dense enough to fall under gravity through duct 68 or 94 onto the conveyor belt 51 or 80. It is regarded as advantageous to supply to the conveyor belt 51 or 80 fibrous material from which the bulk of conveying or entraining air has been removed and consequently having a higher density than the fibrous material used in typical conventional air-laying procedures.

The fibrous material should have a moisture content of no more than 30 percent (and preferably from 15 to 5 percent) by weight on the total weight of the pulp when it is supplied to the cyclone 111. The pulp deposited on the conveyor belt 51 or 80 from the flash dryer and cyclone may be at a temperature of from 60° to 100° C. but can be cooled by gas drawn through it while it is on the conveyor belt.

What is claimed is:

1. A process for consolidating fibrous wood pulp material to produce a coherent sheet of wood pulp, said process comprising the steps of:

(1) reducing the moisture content of the fibrous wood pulp material to not more than 30 percent by weight on the total weight of the fibrous wood pulp material, (2) supplying said fibrous wood pulp material to a hopper located above a gas-pervious continuous conveyor belt, said conveyor belt acting as a base for the hopper, (3) drawing gas through said conveyor belt and through the fibrous wood pulp material on said conveyor belt, (4) carrying the dry fibrous wood pulp material on said conveyor belt away from said hopper through an exit between a lower edge of a front wall of said hopper and said conveyor belt to form a mat of fibrous wood pulp material having a substantially uniform depth, (5) maintaining the average rates of steps (2) and (4) such that the level of the fibrous wood pulp material resting on said conveyor belt in said hopper remains above said exit, thereby ensuring the continual presence of a body of fibrous wood pulp material in said hopper, and (6) applying pressure to said mat in at least two stages subsequent to carrying the mat away from said hopper on said conveyor belt to consolidate the mat of fibrous wood pulp material to form a coherent sheet, in the first of which stages the mat is pressed to a density of from 0.05 to 0.10 g/cc and in the second of which stages the mat is pressed to a density of from 0.1 to 0.5 g/cc.

2. A process as claimed in claim 1 wherein the moisture content of said fibrous wood pulp material is reduced from 15 to 5 percent by weight on the total weight of the fibrous wood pulp material before said fibrous wood pulp material is supplied to said hopper.

3. A process as claimed in claim 2 wherein the moisture content of said fibrous wood pulp material is reduced from 12 to 8 percent by weight on the total weight of the fibrous wood pulp material in a flash drying procedure before said fibrous wood pulp material is supplied to said hopper.

4. A process as claimed in claim 3 wherein said exit is formed between the conveyor belt and a freely rotatable roller extending across and above said conveyor belt forwardly adjacent and partially below the bottom edge of said front wall of the hopper, and the mat leaving the hopper is passed beneath said roller to prevent said fibrous wood pulp material from sticking in said hopper near said exit.

5. A process as claimed in claim 4 wherein said hopper has a length dimension between said front wall and a rear wall spaced therefrom and parallel to it, and said length dimension of said hopper is no more than four times the distance between the conveyor belt and said roller.

6. A process as claimed in claim 5 wherein said length dimension of said hopper is approximately three times the distance between the conveyor belt and said roller.

7. A process as claimed in claim 1 wherein said mat of fibrous wood pulp material is carried by the conveyor belt away from the front wall of the hopper into a housing which encloses said mat of fibrous wood pulp material on the conveyor belt and wherein said mat is subjected to the action of means for applying pressure thereto to carry out said first stage of consolidation of said mat, after which it is carried by said conveyor belt to means for completing said second stage of consolidation.

8. A process as claimed in claim 7 wherein said mat on the conveyor belt in said housing is subjected to the action of a trimming device prior to said first stage of consolidation to remove from the mat protrusions of fibrous wood pulp material above a pre-determined level set by the spacing of said trimming device above said conveyor belt.

9. A process as claimed in claim 7 wherein said mat on the conveyor belt in said housing is subjected prior to said first stage of consolidation to the action of a trimming device constituted by a roller with projecting blades, which roller is rotated at an angular speed such that the tips of the blades move at a linear speed which is high in relation to the linear speed of movement of the conveyor belt and so that the blades closest to the conveyor belt move in a direction opposite to that of the conveyor belt, said trimming device serving to remove from the mat protrusions of fibrous wood pulp material above a pre-determined level, and the mat of fibrous wood pulp material in the region of the trimming device is subjected to the suction effect of gas drawn through said mat from said housing.

10. A process as claimed in claim 7 wherein said means for applying pressure to carry out said first consolidation stage are pressure rollers applying a pressure in the region of 4.5 kg/linear cm and the means for applying pressure to carry out said second consolidation stage are pressure rollers applying a pressure in the region of 90 kg/linear cm.

* * * * *

UNITED STATES PATENT AND TRADEMARK OFFICE

CERTIFICATE OF CORRECTION

PATENT NO. : 4,263,239

DATED : April 21, 1981

INVENTOR(S) : Dunbar, John H. and Gray, Kenneth L.

It is certified that error appears in the above-identified patent and that said Letters Patent are hereby corrected as shown below:

Col. 5, lines 41-42, "embodiment" should be --apparatus--.

Col. 5, line 60, "corespondence" should be --correspondence--.

Col. 6, line 6, "exammple" should be --example--.

Col. 6, line 40, "applies" should be --applied--.

Col. 6, line 45, "sucton" should be --suction--.

Signed and Sealed this

*Seventeenth* Day of *November 1981*

[SEAL]

*Attest:*

GERALD J. MOSSINGHOFF

*Attesting Officer*

*Commissioner of Patents and Trademarks*